US009840000B2

(12) United States Patent
Juvonen et al.

(10) Patent No.: US 9,840,000 B2
(45) Date of Patent: Dec. 12, 2017

(54) HYDRAULIC HAMMER HAVING VARIABLE STROKE CONTROL

(71) Applicant: Caterpillar Inc., Peoria, IL (US)

(72) Inventors: Vaino Esko Juvonen, Espoo (FI); Cody Moore, Waco, TX (US)

(73) Assignee: Caterpillar Inc., Peoria, IL (US)

( * ) Notice: Subject to any disclaimer, the term of this patent is extended or adjusted under 35 U.S.C. 154(b) by 404 days.

(21) Appl. No.: 14/574,326

(22) Filed: Dec. 17, 2014

(65) Prior Publication Data

US 2016/0176033 A1 Jun. 23, 2016

(51) Int. Cl.

| | |
|---|---|
| ***B25D 9/26*** | (2006.01) |
| ***B25D 9/14*** | (2006.01) |
| ***B25D 9/18*** | (2006.01) |

(52) U.S. Cl.

CPC ..... *B25D 9/26* (2013.01); *B25D 9/145* (2013.01); *B25D 9/18* (2013.01)

(58) Field of Classification Search

CPC ..... B25D 9/16; B25D 9/18; B28D 1/26
USPC ..... 173/206, 207, 90, 91; 299/69
See application file for complete search history.

(56) References Cited

U.S. PATENT DOCUMENTS 4,635,531 A * 1/1987 Rode ..... B25D 9/145 91/303
4,800,797 A * 1/1989 Comarmond ..... B25D 9/26 91/307
4,899,836 A * 2/1990 Vernot ..... B25D 9/26 173/207
5,134,989 A 8/1992 Akahane
5,653,295 A 8/1997 Jovonen et al.
5,669,281 A * 9/1997 Comarmond ..... B25D 9/26 91/245
5,890,548 A 4/1999 Juvonen
5,979,291 A * 11/1999 Juvonen ..... B25D 9/145 91/239
6,959,967 B1 * 11/2005 Prokop ..... B25D 9/26 173/206
7,779,930 B2 * 8/2010 Lohmann ..... B25D 9/265 173/115
2001/0022229 A1 * 9/2001 Deimel ..... B25D 9/14 173/206

(Continued)

FOREIGN PATENT DOCUMENTS

| | | |
|---|---|---|
| DE | 19507348 | 9/1996 |
| EP | 0752297 | 1/1997 |

(Continued)

*Primary Examiner* — Nathaniel Chukwurah
(74) *Attorney, Agent, or Firm* — Finnegan, Henderson, Farabow, Garrett & Dunner, L.L.P.

(57) ABSTRACT

A variable stroke control system for a hydraulic hammer is disclosed. The variable stroke control system may include an inlet groove formed around a piston associated with the hydraulic hammer and configured to receive pressurized fluid, and an outlet groove formed around the piston associated with the hydraulic hammer and configured to discharge the pressurized fluid. The variable stroke control system may further include a valve in fluid communication with the inlet groove and the outlet groove, and configured to selectively adjust a stroke length of the piston based on a change in pressure differential between the inlet groove and the outlet groove.

4 Claims, 3 Drawing Sheets

(56) References Cited

U.S. PATENT DOCUMENTS

| | | | | |
|---|---|---|---|---|
| 2012/0138328 | A1* | 6/2012 | Teipel | B25D 9/12 173/207 |
| 2014/0262407 | A1* | 9/2014 | Moore | B25D 9/145 173/208 |

FOREIGN PATENT DOCUMENTS

| | | |
|---|---|---|
| EP | 0778110 | 6/1997 |
| JP | 2007-196293 | 8/2007 |

* cited by examiner

HYDRAULIC HAMMER HAVING VARIABLE STROKE CONTROL

TECHNICAL FIELD

The present disclosure is directed to a hydraulic hammer and, more particularly, to a hydraulic hammer having variable stroke control.

BACKGROUND

Hydraulic hammers can be attached to various machines such as excavators, backhoes, tool carriers, or other like machines for the purpose of milling stone, concrete, and other construction materials. The hydraulic hammer is mounted to a boom of the machine and connected to a hydraulic system. High pressure fluid in the hydraulic system is supplied to the hammer to drive a reciprocating piston in contact with a work tool, which in turn causes the work tool to reciprocate while in contact with the construction material.

Typical hydraulic hammers drive the reciprocating piston to contact the work tool with the same continuous stroke. In other words, a stroke length of the reciprocating piston does not change during operation of the hammer. However, some hydraulic hammers are capable of changing the stroke length (e.g., between shorter and longer strokes), which can provide more efficiency in some hammer operations.

An exemplary system for changing the stroke length of a hydraulic hammer is disclosed in U.S. Pat. No. 5,669,281 (the '281 patent) that issued to Comarmond on Sep. 23, 1997. Specifically, the '281 patent discloses a percussive machine having a piston that slides in a cylinder and strikes a tool during each cycle. The percussive machine also has a top chamber and a bottom chamber which are fed sequentially with fluid through a distributor controlled by a control device. The percussive machine further includes a selector piston mounted in the cylinder. The selector piston may be controlled by the control device with pressurized fluid to shift the selector piston in and out of a position that lengthens the stroke of the piston.

Although the percussive machine of the '281 patent may be adequate for some applications, it may still be less than optimal. In particular, the percussive machine of the '281 patent may be overly complex and require many additional parts. As a result, retrofitting existing hydraulic hammers with one continuous stroke to have an adjustable stroke would be difficult to achieve with the percussive machine of the '281 patent. In addition, the percussive machine of the '281 patent operates initially in a short stroke mode and is later switched to long stroke mode after a period of operation. In some instances, however, it may be desirable to start in the long stroke mode initially to increase the efficiency of the hammer operation.

The disclosed system is directed to overcoming one or more of the problems set forth above and/or other problems of the prior art.

SUMMARY

In one aspect, the present disclosure is directed to a variable stroke control system for a hydraulic hammer. The variable stroke control system may include an inlet groove formed around a piston associated with the hydraulic hammer and configured to receive pressurized fluid, and an outlet groove formed around the piston associated with the hydraulic hammer and configured to discharge the pressurized fluid. The variable stroke control system may further include a valve in fluid communication with the inlet groove and the outlet groove, and configured to selectively adjust a stroke length of the piston based on a change in pressure differential between the inlet groove and the outlet groove.

In another aspect, the present disclosure is directed to a variable stroke control system for a hydraulic hammer. The variable stroke control system may include an inlet groove formed around a piston associated with the hydraulic hammer and configured to receive pressurized fluid, and an outlet groove formed around the piston associated with the hydraulic hammer and configured to discharge the pressurized fluid. The variable stroke control system may further include a valve in fluid communication with the inlet groove and the outlet groove, and configured to selectively adjust a stroke length of the piston based on a hardness of a material impacted by a work tool of the hydraulic hammer. An initial stroke of the piston may be longer than a subsequent stroke of the piston.

In yet another aspect, the present disclosure is directed to a hydraulic hammer system. The hydraulic hammer system may include a piston, and a sleeve disposed external and co-axial to the piston. The hydraulic hammer system may also include an inlet groove formed at a first internal surface of the sleeve and configured to receive pressurized fluid from a pump, and an outlet groove formed at a second internal surface of the sleeve and configured to direct pressurized fluid to a return tank. The outlet groove may be fluidly connected to the inlet groove. The hydraulic hammer system may further include a first valve configured to control a transition timing between upward and downward movements of the piston, and a second valve in fluid communication with the inlet groove and the outlet groove, and configured to selectively adjust a stroke length of the piston by delaying a transition timing of the first valve.

DETAILED DESCRIPTION

Figure 1:
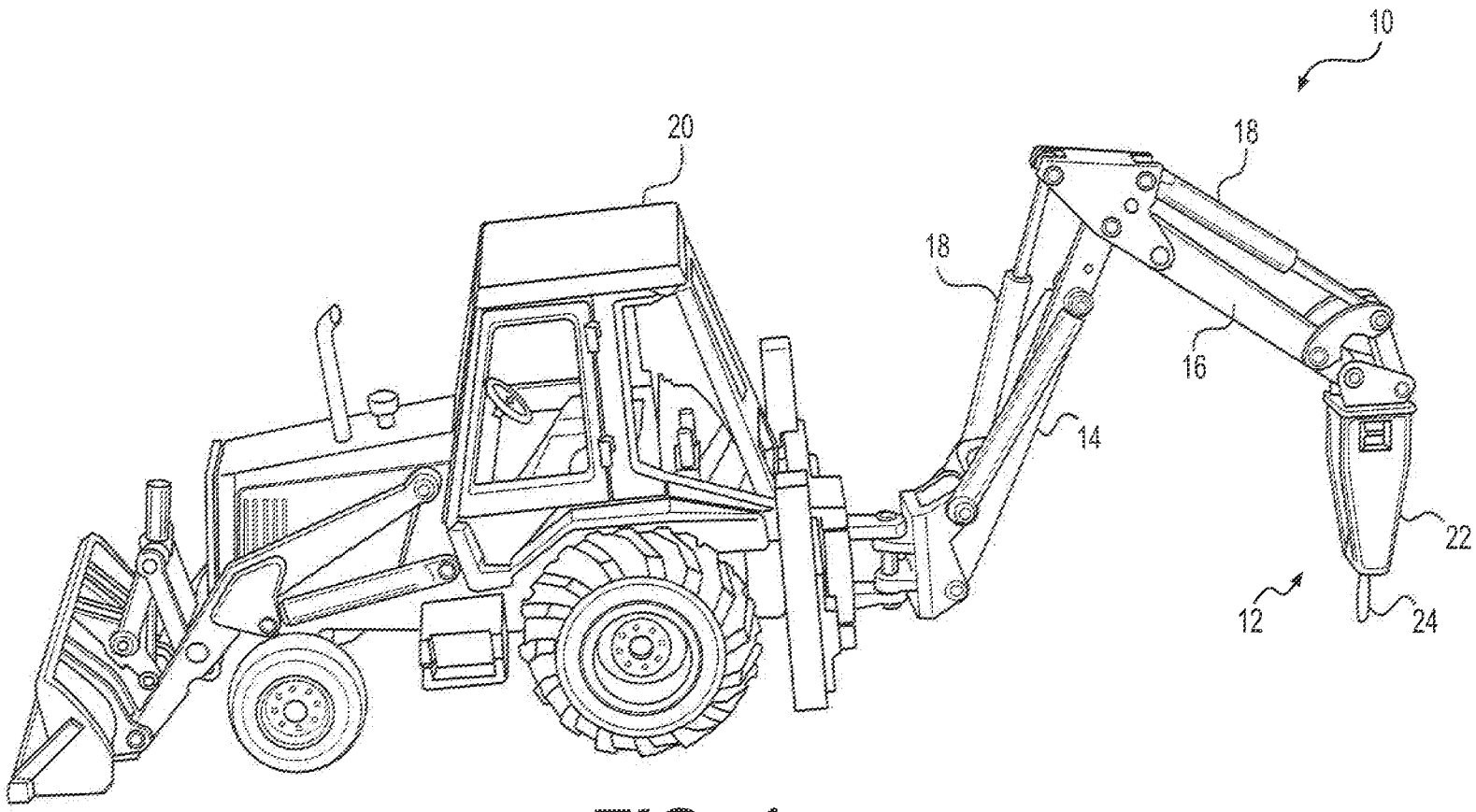
FIG. 1 is a pictorial illustration of an exemplary disclosed machine.

FIG. 1 illustrates an exemplary disclosed machine 10 having a hammer 12. Machine 10 may be configured to perform work associated with a particular industry such as, for example, mining or construction. Machine 10 may be a backhoe loader (shown in FIG. 1), an excavator, a skid steer loader, or any other machine. Hammer 12 may be pivotally connected to machine 10 through a boom 14 and a stick 16. However, it is contemplated that another linkage arrangement may alternatively be utilized, if desired.

In the disclosed embodiment, one or more hydraulic cylinders 18 may raise, lower, and/or swing boom 14 and stick 16 to correspondingly raise, lower, and/or swing hammer 12. The hydraulic cylinders 18 may be connected to a hydraulic supply system (not shown) within machine 10. Specifically, machine 10 may include a pump (not shown) connected to hydraulic cylinders 18 and to hammer 12 through one or more hydraulic supply lines (not shown). The hydraulic supply system may introduce pressurized fluid, for example oil, from the pump into the hydraulic cylinders 18 and hammer 12. Operator controls for movement of hydraulic cylinders 18 and/or hammer 12 may be located within a cabin 20 of machine 10.

Figure 2:
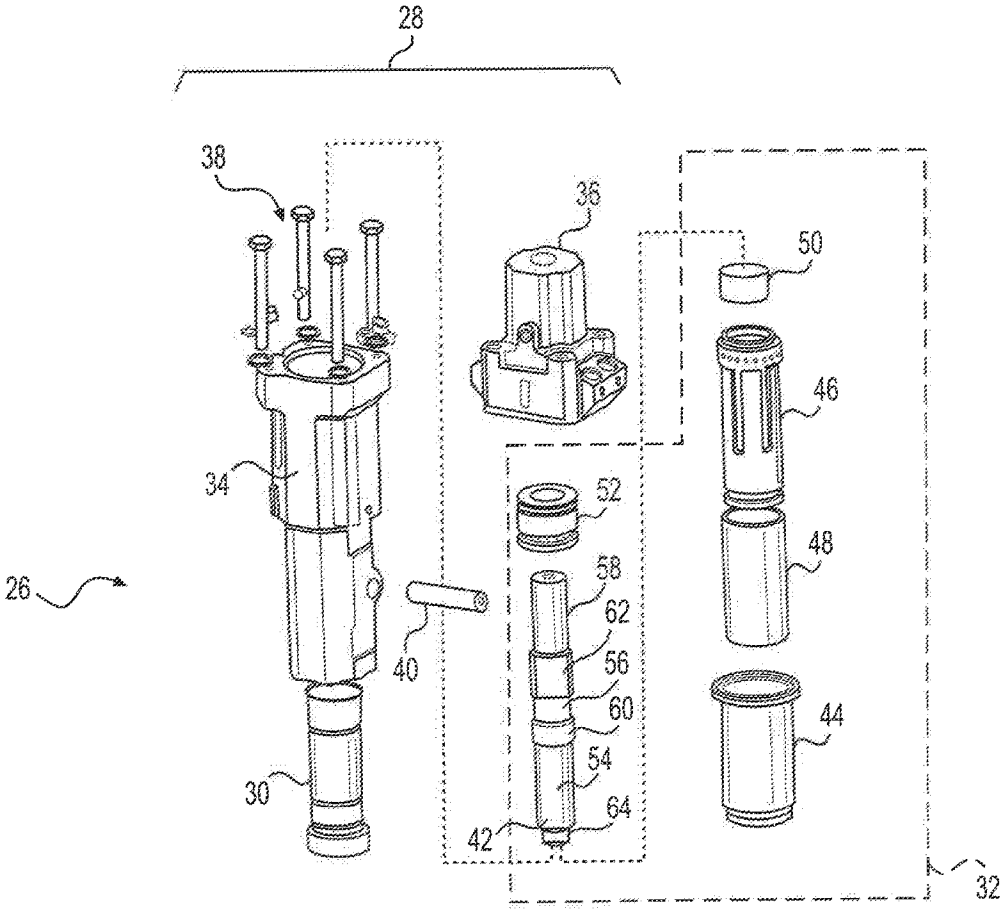
FIG. 2 is an exploded view of an exemplary disclosed hydraulic hammer assembly that may be used with the machine of FIG. 1.

As shown in FIGS. 1 and 2, hammer 12 may include an outer shell 22 and an actuator assembly 26 located within outer shell 22. Outer shell 22 may connect actuator assembly 26 to stick 16 and provide protection for actuator assembly 26. A work tool 24 may be operatively connected to an end of actuator assembly 26 opposite stick 16. It is contemplated that work tool 24 may include any known tool capable of interacting with hammer 12. In one embodiment, work tool 24 includes a chisel bit.

As shown in FIG. 2, actuator assembly 26 may include a subhousing 28, a bushing 30, and an impact system 32. Subhousing 28 may include, among other things, a frame 34 and a head 36. Frame 34 may be a hollow cylindrical body having one or more flanges or steps along its axial length. Head 36 may cap off one end of frame 34. Specifically, one or more flanges on head 36 may couple with one or more flanges on frame 34 to provide a sealing engagement. One or more fastening mechanisms 38 may rigidly attach head 36 to frame 34. In some embodiments, fastening mechanisms 38 may include, for example, screws, nuts, bolts, or any other means capable of securing the two components. Additionally, frame 34 and head 36 may each include holes to receive fastening mechanisms 38.

Bushing 30 may be disposed within a tool end of subhousing 28 and may be configured to connect work tool 24 to impact system 32. A pin 40 may connect bushing 30 to work tool 24. When displaced by hammer 12, work tool 24 may be configured to move a predetermined axial distance within bushing 30.

Impact system 32 may be disposed within an actuator end of subhousing 28 and be configured to move work tool 24 when supplied with pressurized fluid. As shown by the dotted lines in FIG. 2, impact system 32 may be an assembly including a piston 42, an accumulator membrane 44, a sleeve 46, a sleeve liner 48, a valve 50, and a seal carrier 52. Sleeve liner 48 may be assembled within accumulator membrane 44, sleeve 46 may be assembled within sleeve liner 48, and piston 42 may be assembled within sleeve 46. All of these components may be generally co-axial with each other. In addition, piston 42, sleeve 46, valve 50, and seal carrier 52 may all be held together as a sub-assembly by way of slip-fit radial tolerances. For example, slip-fit radial tolerances may be formed between sleeve 46 and piston 42, and between seal carrier 52 and piston 42. Sleeve 46 may apply an inward radial pressure on piston 42, and seal carrier 52 may apply an inward radial pressure on piston 42. Such a configuration may hold sleeve 46, seal carrier 52, and piston 42 together as a sub-assembly.

Accumulator membrane 44 may form a cylindrical tube configured to hold a sufficient amount of pressurized fluid for hammer 12 to drive piston 42 through at least one stroke. Accumulator membrane 44 may be radially spaced apart from sleeve 46 when accumulator membrane 44 is in a relaxed state (i.e. not under pressure from pressurized gas). However, when accumulator membrane 44 is under pressure from the pressurized gas, no spacing may exist between accumulator membrane 44 and sleeve 46, and fluid flow therebetween may be inhibited.

Valve 50 may be assembled over an end of piston 42 and located radially inward of both sleeve 46 and seal carrier 52. A portion of seal carrier 52 may axially overlap with sleeve 46. Additionally, valve 50 may be disposed axially external to accumulator membrane 44. Valve 50 and seal carrier 52 may be located entirely within head 36. Accumulator membrane 44, sleeve 46, and sleeve liner 48 may be located within frame 34. Head 36 may be configured to close off an end of sleeve 46 when connected to frame 34.

Piston 42 may be configured to slide within both frame 34 and head 36. For example, piston 42 may be configured to reciprocate within frame 34 and contact an end of work tool 24. Specifically, a compressible gas (e.g., nitrogen gas) may be disposed in a gas chamber (not shown) located within head 36 at an end of piston 42 opposite bushing 30. Piston 42 may be slideably moveable within the gas chamber to increase and decrease the size of the gas chamber. A decrease in size of the gas chamber may increase the gas pressure within the gas chamber, thereby driving piston 42 downward to contact work tool 24.

Piston 42 may comprise varying diameters along its length, for example one or more narrow diameter sections disposed axially between wider diameter sections. In the disclosed embodiment, piston 42 includes three narrow diameter sections 54, 56, 58, separated by two wide diameter sections 60, 62. Narrow diameter sections 54, 56, 58 may cooperate with sleeve 46 to selectively open and close fluid pathways within sleeve 46. Piston 42 may further include an impact end 64 having a smaller diameter than any of narrow diameter sections 54, 56, 58. Impact end 64 may be configured to contact work tool 24 within bushing 30.

Figure 3:
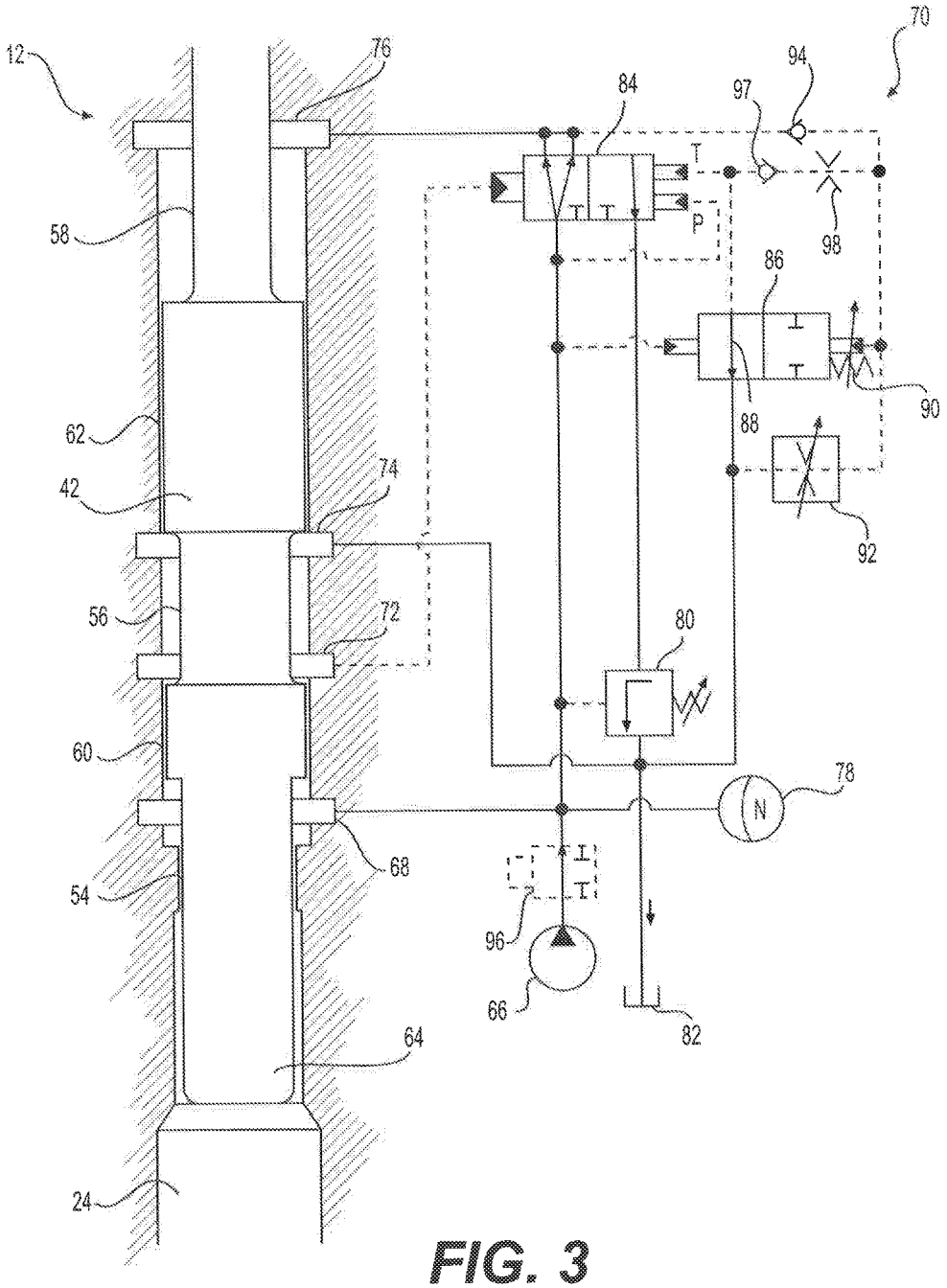
FIG. 3 is a schematic illustration of an exemplary disclosed variable stroke control system that may be used with the hydraulic hammer of FIG. 2.

As shown in FIG. 3, hammer 12 may be equipped with a variable stroke control system 70. Variable stroke control system 70 may include one or more components configured to direct pressurized fluid within hammer 12 to selectively adjust a stroke length of piston 42. For example, variable stroke control system 70 may include a pump 66, an annular lift groove 68, an annular switch groove 72, an annular tank groove 74, an annular outlet groove 76, an accumulator 78, a pressure control valve 80, a return tank 82, and a main control valve 84.

Pump 66 may be configured to pressurize and direct fluid to lift groove 68 and accumulator 78. Lift groove 68 may be configured to direct fluid to contact a shoulder at wide diameter section 60 in order to force piston 42 in an upward direction. Switch groove 72 may be configured to fluidly communicate with main control valve 84 to switch a valve position of main control valve 84. Tank groove 74 and outlet groove 76 may be configured to direct the pressurized fluid to tank 82. Lift groove 68, switch groove 72, tank groove 74, and outlet groove 76 may all be formed as concentrically arranged passages around piston 42. Movement of piston 42 (i.e., of narrow diameter sections 54, 56, 58 and wide diameter sections 60, 62) may selectively open or close the grooves to cause movement of piston 42.

Accumulator 78 may be fluidly connected to pump 66 and configured to accumulate pressurized fluid and control pulsations of the fluid within the hydraulic circuit. Pressure control valve 80 may be fluidly connected to tank 82 and configured to regulate a flow rate of fluid that is returned to tank 82, such that a pressure within the hydraulic circuit is controlled to a desired level. Accumulator 78 and pressure control valve 80 may work together to control pulsations and pressures within the hydraulic circuit. In some embodiments, pressure control valve 80 may also cause piston 42 to return to an uppermost position within sleeve 46 when a hammer operation has stopped. In particular, pressure control valve may cause a pressure at outlet groove 76 to decrease, such that a pressure at lift groove 68 is greater than a pressure at outlet groove 76, causing piston 42 to move to the uppermost position. As a result, piston 42 may always start a new hammer operation with a longer initial stroke of piston 42. Without pressure control valve 80, the piston 42 would return to a position lower than the uppermost position, which would result in a smaller initial stroke of piston 42.

Main control valve 84 may be disposed between pump 66 and tank 82, and configured to control transition timing between movements of piston 42. In particular, main control valve 84 may control when piston 42 transitions between upward and downward movements. Main control valve 84 may include a valve element movable between two distinct positions. When the valve element is in the first position (right-most position shown in FIG. 3), outlet groove 76 may be fluidly connected to tank 82. When the valve element is in the second position (left-most position shown in FIG. 3), outlet groove 76 may be fluidly connected to pump 66. The valve element may move between the first and second positions depending on a pressure level within the switch groove 72. Specifically, when the pressure level within the switch groove 72 is below a threshold amount, the valve element may be forced to the first position. Alternatively, when the pressure level within the switch groove 72 is greater than the threshold amount, the valve element may be forced to the second position.

As shown in FIG. 3, variable stroke control system 70 may also include a stroke control valve 86 configured to selectively adjust a stroke length of piston 42 based on a pressure differential between lift groove 68 and outlet groove 76. Stroke control valve 86 may be disposed in a switching passage fluidly connecting main control valve 84 and tank 82. Stroke control valve 86 may include a movable valve element 88 and a spring 90. Valve element 88 may be configured to move between a flow blocking position (e.g., closed position) and a flow passing position (e.g., open position) in response to the pressure differential between lift groove 68 and outlet groove 76. Specifically, when the pressure differential is below a threshold amount, valve element 88 may be forced to the flow passing position. Alternatively, when the pressure differential is greater than the threshold amount, valve element 88 may be forced to the flow blocking position. Spring 90 may bias valve element 88 to the flow blocking position. The threshold pressure differential may be indicative of a hardness of a construction material impacted by work tool 24.

In some embodiments, variable stroke control system 70 may further include a first orifice 92, a first check valve 94, a second orifice 98, and a second check valve 97. Orifice 92 may be disposed in a passage between outlet groove 76 and tank 82, and configured to reduce a mass flow rate of fluid flowing therethrough. Check valve 94 may be disposed in a passage between outlet groove 76 and orifice 92, and configured to provide a unidirectional flow from outlet groove 76 to orifice 92. Orifice 98 may be disposed in a passage between check valve 94 and main control valve 84, and configured to reduce a mass flow rate of fluid flowing therethrough. Check valve 97 may also be disposed in the passage between check valve 94 and main control valve 84, and configured to provide a unidirectional flow from check valve 94 to main control valve 84. It is contemplated that hydraulic hammer 12 may include other orifices, valves, grooves, and/or other components in addition to those included in variable stroke control system 70, as desired.

INDUSTRIAL APPLICABILITY

The disclosed variable stroke control system may be used in any hydraulic hammer application. In particular, the disclosed variable stroke control system may automatically adjust a stroke length of a piston of the hydraulic hammer based on a pressure differential between a pressurized fluid inlet and a pressurized fluid outlet. More specifically, the stroke length of the piston may be adjusted based on a hardness of a construction material impacted by the hydraulic hammer. Operation of hammer 12 will now be described in detail.

Referring to FIG. 3, an operator request may be made to begin operation of hammer 12 via, for example, an operator valve 96. After the request is made, pump 66 may direct pressurized fluid, for example pressurized oil, into lift groove 68 and accumulator 78. A sufficient amount of oil within lift groove 68 may apply an upward pressure on piston 42. Specifically, the oil within lift groove 68 may apply pressure to the shoulder of wide diameter section 60 and bias piston 42 upward.

Movement of piston 42 upward may open switch groove 72. Specifically, movement of piston 42 upward may correspondingly move narrow diameter section 54 to a location adjacent to switch groove 72. While switch groove 72 is uncovered, pressurized fluid may flow from inlet groove 68 into switch groove 72, thereby increasing the pressure level at switch groove 72 and causing main control valve 84 to be switched from the first position (right-most position shown in FIG. 3) to the second position (left-most position shown in FIG. 3). Subsequently, pressurized fluid from pump 66 may be allowed to flow through main control valve 84 and towards outlet groove 76.

As pressurized fluid flows from pump 66 through main control valve 84 and towards outlet groove 76, movement of piston 42 upwards may also cause narrow diameter section 58 to reduce the size of the gas chamber. This reduction in size may further pressurize nitrogen gas within the gas chamber, thereby biasing piston 42 downward. Such biasing may increase the pressure downward on piston 42, causing piston 42 to accelerate downward and contact work tool 24, which in turn causes work tool 24 to accelerate downward and impact a construction material.

At an impacting position (as shown in FIG. 3), switch groove 72 may be in fluid communication with tank groove 74, which decreases the pressure level at switch groove 72 and causes main control valve 84 to be switched back to the first position (right-most position shown in FIG. 3). The impact with the construction material may then cause piston 42 to accelerate upwards. The acceleration of piston 42 may vary depending on a hardness of the construction material. For example, impacting a harder construction material may cause piston 42 to have a higher acceleration upwards, while impacting a softer construction material may cause piston 42 to have a lower acceleration upwards. This acceleration of piston 42 may result in a change in pressure differential between lift groove 68 and outlet groove 76. The pressure differential may also be indicative of the hardness of the construction material. For example, impacting a harder construction material may result in a greater pressure differential between lift groove 68 and outlet groove 76, while impacting a softer construction material may result in a smaller pressure differential between lift groove 68 and outlet groove 76. In one embodiment, work tool 24 may penetrate through a surface of a harder construction material by only about 0.5 to 1.0 mm, while work tool 24 may penetrate through a surface of a softer construction material by about 10 mm.

When work tool 24 contacts a harder construction material, the pressure differential threshold may be exceeded, and valve element 88 of stroke control valve 86 may be forced to the flow blocking position. In this position, flow through the switching passage between main control valve 84 and tank 82 may be blocked. As a result, this may delay a switching operation of main control valve 84. In particular, as piston 42 accelerates upwards, main control valve 84 may take longer to switch from the first position (right-most position shown in FIG. 3) to the second position (left-most position shown in FIG. 3). This may allow piston 42 to move further upwards than normal operation, resulting in a longer stroke of piston 42 that provides higher impact energy and lower frequency.

When work tool 24 contacts a softer construction material, the pressure differential threshold may not be exceeded, and valve element 88 of stroke control valve 86 may remain in the flow passing position. In this position, flow through the switching passage between main control valve 84 and tank 82 may be allow, and the switching operation of main control valve 84 operates normally. When main control valve 84 switches from the first position (right-most position shown in FIG. 3) to the second position (left-most position shown in FIG. 3), this may result in a shorter stroke of piston 42 than when work tool 24 contacts a harder construction material. The shorter stroke may provide lower impact energy and higher frequency. It is contemplated that the impact energy may also be varied with a pressure regulated by pressure control valve 80. In some embodiments, pressure control valve 80 may cause the hydraulic circuit to have higher pressure when operating with shorter strokes of piston 42.

Piston 42 may continue to reciprocate up and down in shorter or longer strokes in response to the hardness of the construction material impacted. Because of the simplified operation of stroke control valve 86, piston 42 can easily switch between longer and shorter strokes. After operation of hammer 12 has stopped (i.e., operator control valve 96 is no longer engaged), piston control valve 80 may cause a pressure at outlet groove 76 to decrease, such that a pressure at lift groove 68 is greater than a pressure at outlet groove 76, causing piston 42 to move to the uppermost position within sleeve 46. As a result, any new operation of hammer 12 will start with a longer initial stroke of piston 42.

The present disclosure may provide an variable stroke control for a hydraulic hammer that includes a stroke control valve that selectively delays a transition timing of a main control valve to allow the hydraulic hammer to switch between shorter and longer strokes. The use of the stroke control valve may simplify a variable stroke control operation and be suitable for retrofitting hydraulic hammers having non-variable stroke control. In addition, by utilizing a pressure control valve, the stroke control valve may be capable of starting the hammer operation with a long stroke.

It will be apparent to those skilled in the art that various modifications and variations can be made to the system of the present disclosure. Other embodiments of the system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A variable stroke control system for a hydraulic hammer, comprising:

an impact system having a piston disposed within a sleeve wherein the piston includes an impact end section, a first narrow diameter section positioned adjacent the impact end section, having a diameter larger than or equal to the impact end section, a first wide diameter section positioned adjacent the first narrow diameter section, having a diameter larger than the first narrow diameter section, a second narrow diameter section positioned adjacent the first wide diameter section, having a diameter smaller than the first wide diameter section, a second wide diameter section, positioned adjacent the second narrow diameter section, having a diameter larger than the second narrow diameter section, a third narrow diameter section positioned adjacent the second wide diameter section, having a diameter smaller than the first narrow diameter section, and no more than four annular grooves formed within the sleeve, adjacent to the piston, the annular grooves including an annular lift groove formed within the sleeve and located co-axially with the piston and configured to permit the flow of pressurized fluid from a hydraulic pump to the first narrow diameter section, an annular outlet groove formed within the sleeve and located co-axially with the piston and configured to permit the flow of pressurized fluid to and from the third narrow diameter section, an annular switch groove formed within the sleeve and located co-axially with the piston between the annular lift groove and the annular outlet groove and configured to receive pressurized fluid from the annular lift groove when the piston is in an uppermost position and the annular switch groove is adjacent to the first narrow diameter section thereby permitting fluid flow between the annular lift groove and the annular switch groove, and an annular tank groove formed within the sleeve and located co-axially with the piston between the annular outlet groove and the annular switch groove, the annular tank groove being positioned closer to the third narrow diameter section of the piston than the annular switch groove and configured to receive pressurized fluid from the annular switch groove when the piston is in a work tool contact position and the annular tank groove is adjacent to the second narrow diameter section thereby permitting fluid flow between the annular switch groove and the annular tank groove to discharge pressurized fluid to a return tank;

a main control valve having a first position and a second position wherein the first position permits fluid flow between the annular outlet groove and the return tank, while blocking fluid flow from the hydraulic pump, and wherein the second position permits fluid flow between the hydraulic pump and the annular outlet groove, while blocking fluid flow to the return tank; and a stroke control valve having a flow blocking position and a flow passing position wherein the flow blocking position blocks fluid flow within a main control valve switching passage, wherein the main control valve switching passage fluidly connects an annular outlet groove-to-return tank passage and the stroke control valve, thereby blocking fluid flow to the return tank, and wherein the flow passing position permits fluid flow within the main control valve switching passage, thereby passing fluid flow to the return tank, wherein fluid pressure from the annular outlet groove-to-return tank passage and fluid pressure from a hydraulic pump-to-main control valve passage biases the main control valve toward the first position and wherein fluid pressure from the annular switch groove biases the main control valve toward the second position, and wherein fluid pressure from the annular outlet groove-to-return tank passage and mechanical force from a spring biases the stroke control valve toward the flow blocking position and wherein fluid pressure from the hydraulic pump-to-main control valve passage biases the stroke control valve toward the flow passing position and configured to selectively adjust piston stroke based on a pressure differential between the annular lift groove and the annular outlet groove.

2. The variable stroke control system of claim 1, further including:

a first orifice located within the annular outlet groove-to-return tank passage between the annular outlet groove and the return tank passage and configured to reduce fluid flow in the annular outlet groove-to-return tank passage;

a first check valve located within the annular outlet groove-to-return tank passage between the annular outlet groove and the return tank;

a first check valve-to-main control valve passage connecting the annular outlet groove-to-return tank passage to the main control valve; and a second check valve located within the first check valve-to-main control valve passage to establish one fluid flow path to the return tank, through the main control valve switching passage, when the stroke control valve is in the flow passing position.

3. The variable stroke control system of claim 2, further including:

a second orifice located within the first check valve-to-main control valve passage between the first check valve and second check valve and configured to reduce fluid flow in the first check valve-to-main control valve passage.

4. A hydraulic hammer comprising:

an actuator assembly;

an outer shell configured to attach the actuator assembly to a stick;

a work tool operatively connected at an end of the actuator assembly opposite of the stick;

a variable stroke control system, including:

an impact system having a piston disposed within a sleeve wherein the piston includes an impact end section, a first narrow diameter section positioned adjacent the impact end section, having a diameter larger than or equal to the impact end section, a first wide diameter section positioned adjacent the first narrow diameter section, having a diameter larger than the first narrow diameter section, a second narrow diameter section positioned adjacent the first wide diameter section, having a diameter smaller than the first wide diameter section, a second wide diameter section, positioned adjacent the second narrow diameter section, having a diameter larger than the second narrow diameter section, a third narrow diameter section positioned adjacent the second wide diameter section, having a diameter smaller than the first narrow diameter section, and no more than four annular grooves formed within the sleeve, adjacent to the piston, the annular grooves including an annular lift groove formed within the sleeve and located co-axially with the piston and configured to permit the flow of pressurized fluid from a hydraulic pump to the first narrow diameter section, an annular outlet groove formed within the sleeve and located co-axially with the piston and configured to permit the flow of pressurized fluid to and from the third narrow diameter section, an annular switch groove formed within the sleeve and located co-axially with the piston between the annular lift groove and the annular outlet groove and configured to receive pressurized fluid from the annular lift groove when the piston is in an uppermost position and the annular switch groove is adjacent to the first narrow diameter section thereby permitting fluid flow between the annular lift groove and the annular switch groove, and an annular tank groove formed within the sleeve and located co-axially with the piston between the annular outlet groove and the annular switch groove, the annular tank groove being positioned closer to the third narrow diameter section of the piston than the annular switch groove and configured to receive pressurized fluid from the annular switch groove when the piston is in a work tool contact position and the annular tank groove is adjacent to the second narrow diameter section thereby permitting fluid flow between the annular switch groove and the annular tank groove to discharge pressurized fluid to a return tank;

a main control valve having a first position and a second position wherein the first position permits fluid flow between the annular outlet groove and the return tank, while blocking fluid flow from the hydraulic pump, and wherein the second position permits fluid flow between the hydraulic pump and the annular outlet groove, while blocking fluid flow to the return tank; and a stroke control valve having a flow blocking position and a flow passing position wherein the flow blocking position blocks fluid flow within a main control valve switching passage, wherein the main control valve switching passage fluidly connects an annular outlet groove-to-return tank passage and the stroke control valve, thereby blocking fluid flow to the return tank, and wherein the flow passing position permits fluid flow within the main control valve switching passage, thereby passing fluid flow to the return tank, wherein fluid pressure from the annular outlet groove-to-return tank passage and fluid pressure from a hydraulic pump-to-main control valve passage biases the main control valve toward the first position and wherein fluid pressure from the annular switch groove biases the main control valve toward the second position, and wherein fluid pressure from the annular outlet groove-to-return tank passage and mechanical force from a spring biases the stroke control valve toward the flow blocking position and wherein fluid pressure from the hydraulic pump-to-main control valve passage biases the stroke control valve toward the flow passing position and configured to selectively adjust piston stroke based on a pressure differential between the annular lift groove and the annular outlet groove.

* * * * *